US006878077B2

(12) United States Patent
Andrews

(10) Patent No.: US 6,878,077 B2
(45) Date of Patent: Apr. 12, 2005

(54) BASEBALL TRAINING DEVICE

(76) Inventor: Mark Andrews, 4961 Hwy. 9, Springfield, AR (US) 72157

( * ) Notice: Subject to any disclaimer, the term of this patent is extended or adjusted under 35 U.S.C. 154(b) by 0 days.

(21) Appl. No.: 10/601,911

(22) Filed: Jun. 24, 2003

(65) Prior Publication Data

US 2004/0266565 A1 Dec. 30, 2004

(51) Int. Cl.[7] ..... A63B 69/00
(52) U.S. Cl. ..... 473/453; 473/415
(58) Field of Search ..... 473/453, 415, 473/417, 422, 429, 423, 451, 426–431, 258; 273/407, 410; 211/33

(56) References Cited

U.S. PATENT DOCUMENTS 533,102 A * 1/1895 Thomson ..... 273/407
1,412,126 A * 4/1922 Mansell-Phayre ..... 211/33
2,094,810 A * 10/1937 Oppenheimer ..... 211/33
4,886,267 A * 12/1989 Licciardi et al. ..... 473/417
5,087,039 A * 2/1992 Laseke ..... 473/417
5,595,384 A * 1/1997 Hardison, Jr. ..... 473/453

* cited by examiner

*Primary Examiner*—Gregory Vidovich
*Assistant Examiner*—M. Chambers
(74) *Attorney, Agent, or Firm*—Dennis B. Haase

(57) ABSTRACT

A training device for batters which provides a visual and sensual indication to the batter that her or she is experiencing one of several swing defects, comprising a series of flexible standards about the perimeter of a proper swing plane leading the batter to make contact with a ball at an imaginary plate.

8 Claims, 3 Drawing Sheets

BASEBALL TRAINING DEVICE

The present invention relates, in a general sense, to a device for teaching and enhancing baseball skills and, more particularly, to a device for teaching batting techniques and improving skills in that area.

BACKGROUND OF THE INVENTION

1. Field of the Invention

Baseball, America's game, once learned on the sandlot and alleys of America, has now become organized from top to bottom. Four and five year olds now begin with "T" ball, in which the ball is placed on an upstanding post, and the child swings at an essentially stationary object.

The child then progresses to Little League, AAU ball, and into school team sports, from the early grades through high school. For those with the requisite skills, there is a chance for a professional contract right out of high school, while others, for a variety of reasons, may decide to play college ball.

The benefits to be derived from playing the game are many and varied. Beginning with the obvious development of eye, hand coordination, the player learns how to run, catch, throw and how to interact with others in a team environment where sportsmanship and the art of being a good winner and loser are learned every day.

Skills learned in the very early years are typically carried forward as the participant grows and matures. It is possible, however, to improve on one's skills beyond that which might be expected as a consequence of natural progression which inevitably comes with age and experience. Indeed, countless time, effort and dollars have been, and continue to be, spent on an unimaginable variety of books and contrivances whose purpose and intent is to enhance one's skills at playing baseball.

Each such device, or writing, adds to the quantum of knowledge, and, to some extent, the skills of those who expose themselves to the learning process. Each, however, seems to focus on a particular aspect of the skill spectrum, while ignoring other, perhaps equally important, aspects of the games dynamics.

2. Overview of the Prior Art

Batting skills appear to be a particular focus of those who have dedicated time and effort to improvement of playing skills. Conventional wisdom appears to suggest that one's batting skills can be materially enhanced by grooving the swing. Slavish adherence to this philosophy has resulted in a rash of devices, memorialized in the patent art, which literally constrain the batter, by confining his or her bat to a particular swing path.

Trippet U.S. Pat. No. 2,985,452 is an early such device which a matrix of horizontal guides are provided to guide the bat. Gilfillan U.S. Pat. No. 5,029,852 carries Trippet a step further by adding a curved guide, thereby permitting the bat to remain on the guide for a longer portion of the batting stroke.

Laske U.S. Pat. No. 5,087,039 adds the baseball holder 65 to a pair of guides that define a channel within which the batter may swing.

Reference is next made to the Hardison, Jr. U.S. Pat. Nos. 5,322,276 and 5,595,384. Hardison proposes a rigid arcuate guide supported on a vertical post. A stop 44 determines the apex of the swing, and one need only slide the bat down the guide to the ball. In theory, at least, repeated sliding of the bat along the guide will groove the swing . . . in theory.

There is another line of devices intended to improve batting skills by strategically positioning the ball, and among those are found the Morrison U.S. Pat. No. 5,478,070 and Bradley U.S. Pat. No. 6,435,990.

Mooney U.S. Pat. No. 6,413,175 is a ball positioning Tee, and Guerriero U.S. Pat. No. 5,951,413 combines a ball positioning tee with some linearly aligned rigid shafts to groove the swing toward the ball.

Finally, Licciardi et al. U.S. Pat. No. 4,88,267 proposes a goose necked tee to permit simulation of a variety of pitches, within a structured environment.

Each of these devices addresses, to a greater or lesser extent, one or more aspects of the swinging of a bat, but none address the totality of the swing, or the problems that often appear when the device is removed, or the player finds himself under the pressure of game conditions.

SUMMARY OF THE INVENTION

The present invention provides the player with a batting training device which transmits to the player a series of warnings that he or she is outside one or more parameters of a good swing. This is accomplished without slavish adherence to a specific swing path which is controlled by a rigid guide and which may not be right for all players, or in all circumstances.

Accordingly, it is a principal objective to provide to a player at all levels, from novice to professional, a swing device which does not restrict the swing to some predetermined path, but rather to provide alerts, or warnings, to the player that he or she may be experiencing a deviation from accepted good technique which may be readily corrected.

Another purpose and objective of the present invention is to permit the player to position a ball at a variety of locations relative to the position of the bat at contact, while providing the benefits attributed to it herein above.

It is a further objective of the present invention to provide a training device which is usable by both left and right handed batters with equal success.

Another, and still further, objective to be accomplished by the device of the present invention is to permit detection of even the more subtle aspects of a good swing, making the device useful to those with greater experience, while permitting the teaching of proper technique to the very young.

The foregoing, as well as other objects and advantages of the present invention will become evident from a reading of the following Detailed Description of a Preferred Embodiment, taken in conjunction with the following drawings, wherein:

DETAILED DESCRIPTION OF A PREFERRED EMBODIMENT

Figure 1:
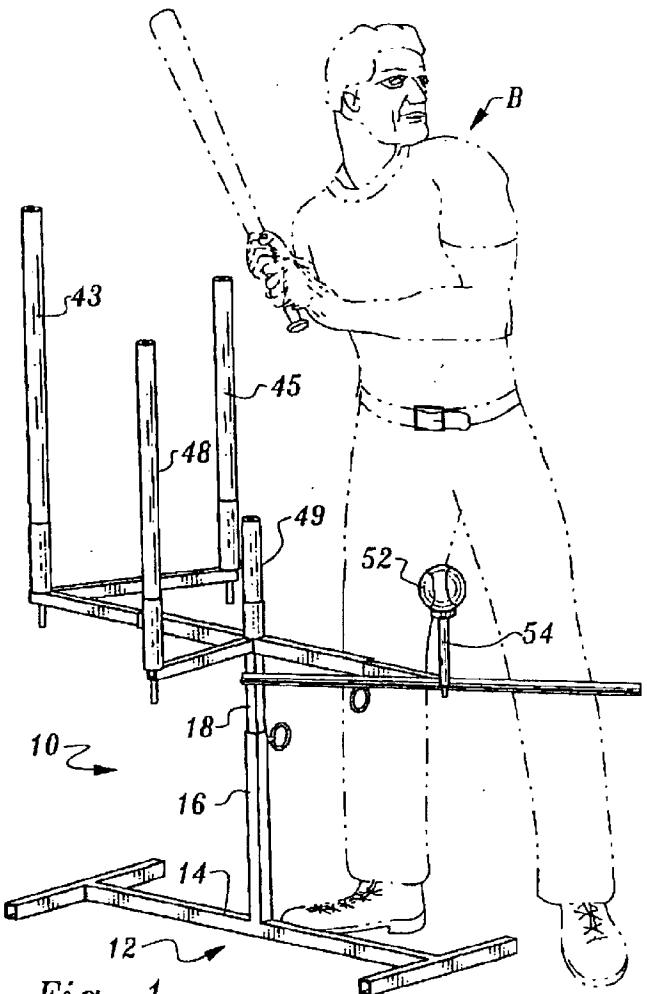
FIG. 1 is a pictorial representation of a right handed batter in a ready position relative to the baseball training device constructed in accordance with the present invention, which position is typical of one which would properly be assumed immediately prior to hitting at the ball.
Figure 4:
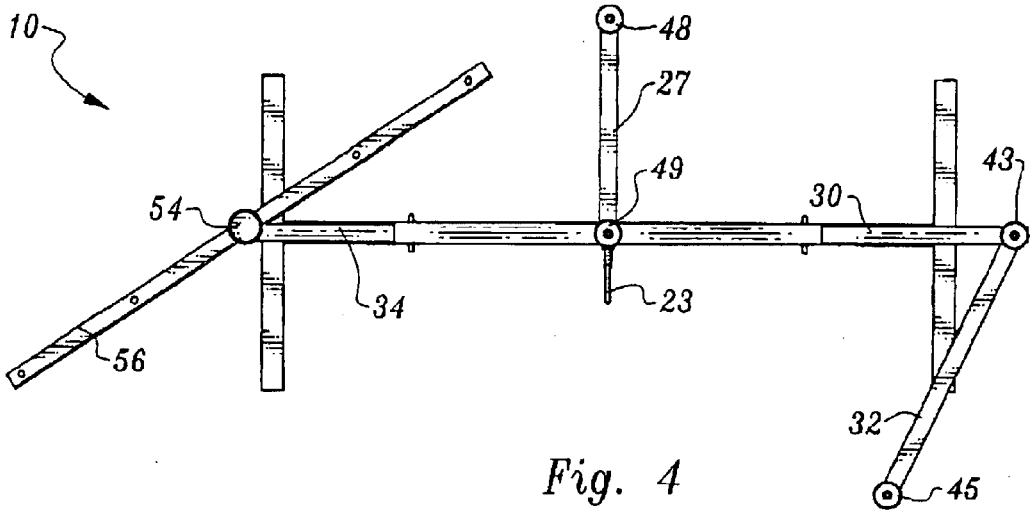
FIG. 4 is a top plan view of the baseball training device of FIG. 3.
Figure 3:
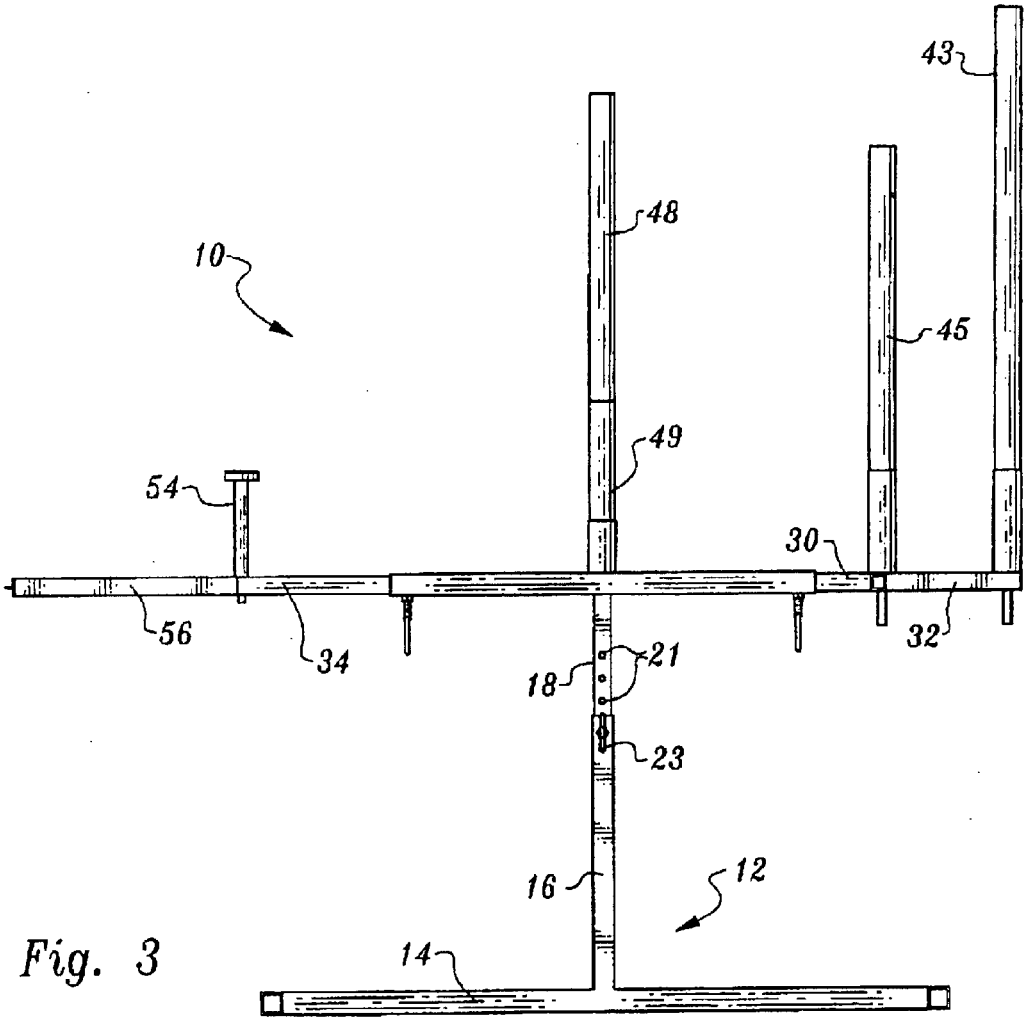
FIG. 3 is a side elevation of the baseball training device of FIG. 1, viewed, again, from the standpoint of a right handed batter.

With reference now to the drawings, and initially to FIG. 1, a baseball training device is there shown at 10. A trainee, in the nature of a right handed batter B stands at the ready in a position he or she would assume immediately prior to the delivery of a pitch from an imaginary pitcher, obviously not shown. It will be appreciated that the present invention will readily accommodate a left handed batter without departure from the basic structure.

The baseball training device 10 of the present invention has been uniquely constructed to provide a batter B with both an audible and sensual signal when the batter B takes a cut at a pitch. In so doing, the device 10 does not construct a rigid swing path for the trainee, but rather provides alerts to his or her senses when the swing made has correctable flaws.

In accordance with the objectives to be achieved by the present invention, the device 10 provides a series of upstanding alerts which will assist the trainee in grooving a swing by avoiding often made mistakes. In support of the device, a stand 12 is provided, comprising a stabilizing foot section 14, which supports an upstanding post 16.

The upstanding post 16 is preferably tubular and an extension tube 18 is telescopingly received in the post 16. A series of apertures 21 are formed in the tube 18, where they are selectively engageable by a pin 23 to set a base height for the alerts which is appropriate for the batter intending to use the device.

The extension tube 18 supports a horizontal cross bar 25, and a leg 27 extends outwardly, at right angles, from the cross bar 25, preferably at the intersection of the crossbar 25 and the extension tube 18.

In order, in accordance with the invention, that the flexibility, and, thus, the utility of the device is optimized, a rear extension 30 is telescopingly received in the rearward portion of the crossbar 25. The rear extension terminates in a right angle member 32. At the opposite end of the crossbar 25, a forward extension 34 is telescopingly received in the cross bar, and pins 36 and 38 affix the extensions in a predetermined position in the crossbar in a well known manner, appropriately adjusted for the particular needs of the batter B.

In keeping with the objectives of the invention, a series of standards are provided which are strategically placed to define an arc for the purposes of assisting a batter in defining the perimeter, or outer limits, of a good swing arc or path, and to do so without rigidly guiding or interfering with the swing. To this end, the rear extension 30 is provided with and supports a vertically extending intermediate standard 41.

The standard 41 is vertically disposed, and preferably positioned at the intersection of the rear extension 30, and the right angle member 32, and is so constructed as to alert a batter executing a swing that he has cast the bat too far away from his or her body, and to provide the alert in a manner that will avoid injury.

To avoid potential injury, a substantial portion 43 of the standard 41 either is of a soft pliable material, e.g., a closed or open cell foam material, or covered with it, and in any event, is sufficiently flexible in order to protect the batter B from physical harm should he or she inadvertently make contact with the standard while practicing within the training device 10.

A second rear standard 45 is strategically located at the free end 47 of the right angle member 32 and is similar in construction and orientation to the standard 41. The standard 45 provides a sensual stimulus in the nature of a warning, if and when the bat contacts the standard upon establishing the batter's ready position with the bat cocked.

Yet another guide is provided in keeping with the invention, and that is the forward standard 48. The standard 48 is suitably secured at the terminus 49 of the leg 27. As in the case of the standards 43 and 45, the standard 48 is upstanding, flexible, and is of foam like material or covered by such material. The standard 48 again provides a sensual alert to the batter if the bat extends beyond the outer limit of the arc of a good swing plane, telling the batter that he or she has cast the bat outwardly, so that it is not in a proper position to hit the ball with the fat part of the bat.

Figure 2:
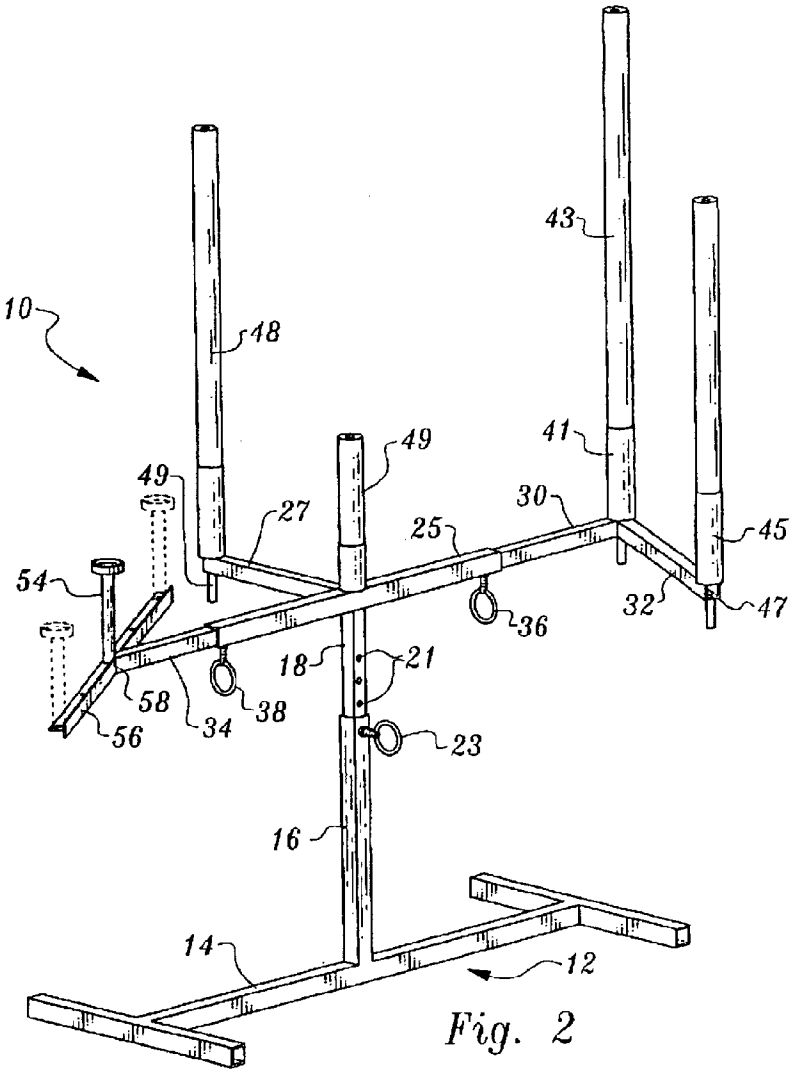
FIG. 2 is the baseball training device of FIG. 1, shown in perspective as viewed from the position of the batter shown in FIG. 1.

Finally, a standard 49 is provided and is located at the point of intersection of the crossbar 25 and the extension 21 and is preferably coaxial with the longitudinal axis of the upstanding post 16. As may be seen, particularly in FIG. 2, the standard 49 is foreshortened, while sharing the same construction and orientation features of the companion standards. The standard 49 establishes a proper horizontal plane for the bat as it approaches the ball and alerts the batter that he or she has dropped the bat below a proper swing plane, making proper contact unlikely.

The training device of the present invention is completed by the provision of a ball 52, supported on a tee 54. The tee 54 is mounted on a cross member 56 located at the outer terminal end 58 of the forward extension 34 and defines a vertical plane that intersects an imaginary plate, thus simulating the ball crossing the plate. It is another feature of the invention that the tee 54 is movable to several positions along the cross member 56 to simulate various inside and outside pitches.

In its preferred embodiment, a batter B, whether left or right handed, establishes his or her position in an imaginary batter's box, with the Tee 56. The training device is intended to assist a batter B in refining his or her swing by providing visual and sensual indicators when some of the more common swing faults are encountered.

As in the case of the standard 45, the standards 43 and 48 provide the batter B with a both a visual and sensual indicator as to the position of the bat, coincidently providing an indicator of the bat's proper position at various points along the swing path. A common fault, referred to as casting, is overcome by virtue of the standards 43 and 48. If the batter allows the bat to get too far out in front of him or her, the end of the bat will contact the standard 43, and if it continues out of alignment, standard 48. If the batter allows his or her arms to sag during the swing, below the proper swing path relative to the ball's position, it will contact the standard 49, alerting the batter to the improper position.

The standard 45 assists the batter in assuming the proper position of the bat as the pitch is delivered. If, for example, the batter reaches too far back, the bat contacts the standard 45, and if its position is not immediately corrected, his or her response time to an approaching pitch is impaired. Moreover, there is a tendency to permit the batter's wrists to relax to the point that the bat is not in a proper position, tending to "flop over", precluding its timely restoration of its proper attitude before the swing is begun. If the bat is too far forward, it will not contact the standard 45 at all, and a loss of power may be anticipated by the foreshortened swing.

Figure 6:
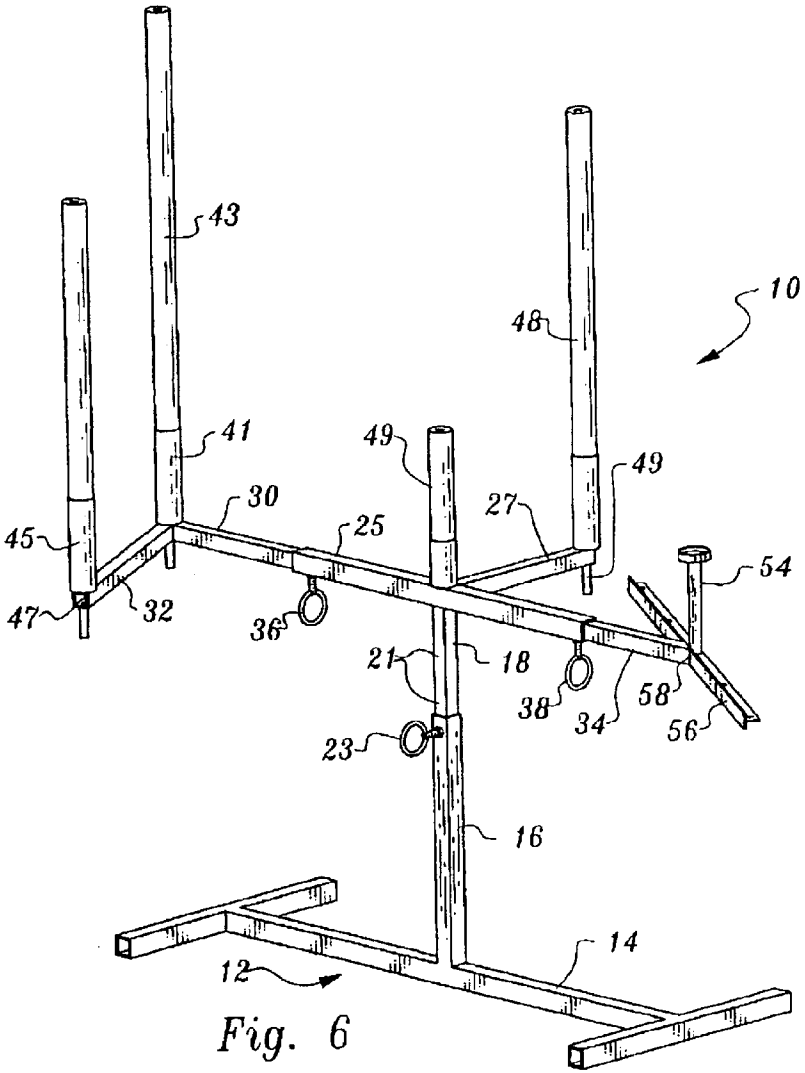
FIG. 6 is a view of the baseball training device of FIG. 1, shown in perspective, as is the case with FIG. 2, but having been repositioned to accommodate a left handed batter.
Figure 5:
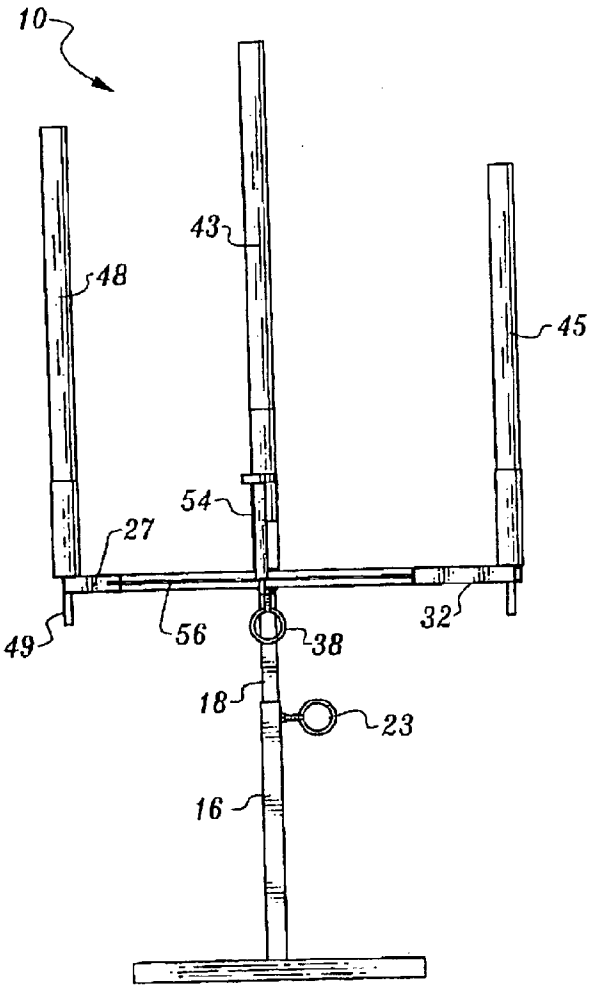
FIG. 5 is an end view of the baseball training device of FIG. 2 looking toward the device, facing the batter.

It will be thus seen that the most vexing swing faults are readily corrected in a safe and efficient manner. It will also be appreciated that the training device of the present invention readily accommodates a left handed batter by simply reversing the position of the cross bar 25 and, thus, the standards, as seen in FIG. 6.

Having thus described a preferred embodiment of the invention, and with a full appreciation that some deviation from the precise structure described is permissible and within the purview of the claims, what is claimed is:

1. A swing training device for baseball players for teaching the proper position of the bat during the swing and assisting in overcoming swing defects, comprising, in combination:

a stand, said stand having a base and an upstanding post;

a cross bar supported on said upstanding post, said crossbar having a horizontal orientation;

a series of strategically positioned upstanding standards mounted on said cross bar, said standards being made of a pliable material, so as to permit a baseball player to feel contact with said standards without altering the baseball player's swing and circumscribing an arc, which arc defines the proper position of the bat during various parts of the swing from a start position through contact with a ball;

one said standard of said series of standards disposed at the rear of the batter, a second standard being located at a point midway in the batter's swing, and yet another of said standards being located at the outermost extension of a proper swing.

2. The swing training device of claim 1, wherein said training device includes a tee, said tee supporting a ball at the proper height and located in the plane of the batter.

3. The swing training device of claim 2, wherein the position of the tee is selectable to permit simulation of a ball as it would appear for both inside and outside pitches.

4. The swing training device of claim 2, wherein the position of the tee relative to the batter is movable forwardly or rearwardly to accommodate the size of the batter.

5. The swing training device of claim 1, wherein the height of said series of standards is adjustable to accommodate the height of the batter.

6. The swing training device of claim 1, wherein said standards are movable to accommodate both left and right handed batters.

7. A swing training device for baseball players to assist in developing a proper swing with a bat, said swing training device including a tee for supporting a ball;

a series of strategically positioned upstanding standards mounted on said cross bar, said standards circumscribing an arc, which arc defines the proper position of the bat during various parts of the swing from a start position through contact with said ball;

one said standard of said series of standards disposed at the rear of the batter, a second standard being located at a point midway in the batter's swing, and yet another of said standards being located at the outermost extension of a proper swing;

a rearward standard is provided, said rearward standard adapted to provide a sensual signal for a baseball player that his bat is in the proper position in preparation for receipt of a pitch;

an intermediate standard is provided, said intermediate standard being adapted to provide a baseball player with a sensual response in the event that the baseball player casts his bat outwardly beyond a proper arc of the swing;

a forward standard, said forward standard providing the baseball player with a sensual response in the event that the baseball player's pose, and accordingly, his bat, are extended beyond a proper arc of the swing;

each of said standards being so constructed as to not interfere with the swing of the bat by the baseball player, while providing a warning touch;

said standards being made of a pliable material, so as to permit a baseball player to feel contact with said standards without altering the baseball player's swing.

8. The training device for baseball players as set forth in claim 7, wherein another standard is provided behind the ball to be hit by the baseball player, said standard being upstanding at a height which provides a sensual signal to the baseball player if the bat is too low as it approaches the ball.

* * * * *